US006732767B2

(12) United States Patent
Baumann

(10) Patent No.: US 6,732,767 B2
(45) Date of Patent: May 11, 2004

(54) CORNER CONNECTION OF A HEDDLE SHAFT

(75) Inventor: Hans Baumann, Horgen (CH)

(73) Assignee: Grob Horgen AG (CH)

( * ) Notice: Subject to any disclaimer, the term of this patent is extended or adjusted under 35 U.S.C. 154(b) by 64 days.

(21) Appl. No.: 10/114,122

(22) Filed: Apr. 3, 2002

(65) Prior Publication Data

US 2003/0062093 A1 Apr. 3, 2003

(30) Foreign Application Priority Data

Apr. 4, 2001 (DE) ..... 101 16 813

(51) Int. Cl.[7] ..... D03C 9/06
(52) U.S. Cl. ..... 139/92; 139/91; 139/93
(58) Field of Search ..... 139/91, 92, 93

(56) References Cited

U.S. PATENT DOCUMENTS

| | | | | |
|---|---|---|---|---|
| 3,180,367 A | | 4/1965 | Kaufmann | 139/91 |
| 4,307,757 A | * | 12/1981 | Shimizu | 139/91 |
| 4,349,052 A | * | 9/1982 | Yaji et al. | 139/92 |
| 4,552,185 A | * | 11/1985 | Graf | 139/91 |
| 5,197,522 A | * | 3/1993 | Bilek et al. | 139/91 |
| 5,280,810 A | * | 1/1994 | Shimizu | 139/91 |
| 5,819,810 A | * | 10/1998 | Kramer et al. | 139/91 |
| 5,871,035 A | * | 2/1999 | Kramer et al. | 139/92 |
| 5,887,629 A | * | 3/1999 | Mettler et al. | 139/91 |
| 5,975,147 A | * | 11/1999 | King et al. | 139/91 |
| 6,131,619 A | * | 10/2000 | Faasse et al. | 139/92 |
| 6,283,163 B1 | * | 9/2001 | Kagi | 139/93 |
| 6,446,676 B1 | * | 9/2002 | Magri et al. | 139/92 |

FOREIGN PATENT DOCUMENTS

| | | |
|---|---|---|
| CH | 427 688 | 7/1967 |
| JP | 37-31518 | 11/1937 |
| JP | 56-39478 | 4/1981 |
| JP | 56-143286 | 10/1981 |
| RU | 105 143 | 10/1983 |

* cited by examiner

*Primary Examiner*—John J. Calvert
*Assistant Examiner*—Robert H. Muromoto, Jr.
(74) *Attorney, Agent, or Firm*—Dykema Gossett PLLC

(57) ABSTRACT

In a connection of a shaft rod to a side strut of a heddle shaft there is at least one guide surface provided in or on the shaft rod. The guide surface extends substantially parallel to the longitudinal axis of the shaft rod. The guide surface engages with a positive fit to a second guide surface extending along a projection of the side strut substantially parallel to the shaft rod or perpendicular to the side strut.

16 Claims, 4 Drawing Sheets

CORNER CONNECTION OF A HEDDLE SHAFT

BACKGROUND OF THE INVENTION

Modern looms place increasing demands on the precision of components. This applies especially to the heddle shafts. They are operating at very high speeds during the weaving operation. It is absolutely necessary that heddle shafts are guided in a sufficiently precise manner to avoid added stress. However, it is an essential prerequisite that the heddle shafts themselves are manufactured in a sufficiently precise manner. Additionally, they must be constructed in such a way that the side struts may be simply disassembled for the insertion of heddles and re-assembled thereafter by having the original precision. Multiple changing of components in weaving mills has the consequence that shaft rods and side struts will be mixed up. Components being manufactured with higher precision solve this problem only to a small degree since larger differences from one production lot to the other is unavoidable. A novel constructional solution is thereby necessary. Corner edge connections from prior art do not, however, fulfill the requirements.

Various attempts are known from the prior art. Since it may be assumed that precise alignment of side struts was not the object of the proposed solution at the time of their creation, one must not be surprised that the precision reached up to now is not sufficient for current demands. According to that disclosed in Swiss patent 427 688 there cannot be achieved sufficient precision merely because of the tolerance or play which the bolt requires within the threads. As disclosed in U.S. Pat. No. 3,180,367 the bolts 22 shown therein would need to be dowel bolts fitted into correspondingly precise borings. However, such a solution is not achievable because of the stress that is currently placed on heddle shafts. The marginal portions 13 according to this prior art patent are either no longer in existence or they must not be weakened anymore by longitudinal borings. The invention disclosed in Japanese patent 56-39 478 has no elements that would make sufficiently precise alignment possible. The same applies for Japanese patent 56-14 3286 and Russian patent 105 143.

A solution for this problem is proposed in Japanese patent 37-31581. However, this is inapplicable for modern heddle shafts based on a completely different shaft profile in its design.

SUMMARY OF THE INVENTION

It is therefore an object of the present invention to propose a corner connection for a heddle shaft that assures simple and precise alignment of side struts and shaft rods in one place at all times, and which additionally fulfills present demands in total to which the heddle shafts are exposed. The invention allows the exchange of side struts and shaft rods with one another while nevertheless maintaining the necessary precision during assembly without extraordinary measures. The main objective is to achieve an alignment of the side struts and the shaft rods in one plane in a simple and repeatable manner.

A corner connection of a heddle shaft is provided according to the invention whereby on or in the shaft rod there is at least a first guide surface provided, which extends nearly parallel to the longitudinal axis of the shaft rod and which engages with a positive fit a second guide surface extending along a projection of the side strut at least nearly parallel to the shaft rod or perpendicular to the side strut.

The solution according to the invention has also the object to provide a corner connection which allows simple detachment of side struts and which always assures the same positioning precision of components during assembly. The positioning precision relates thereby to the twisting of components against one another and their alignment in one plane. Positioning is achieved according to the invention whereby guide surfaces are placed on the ends of the shaft rods and on each projection of the side strut, respectively, which ensures precise positioning as soon as said guide surfaces engage one another. The same precision in positioning is also achieved after detachment of the connection and reassembly of the components.

In a preferred embodiment, guide surfaces required for the side struts are placed directly on the projection of the side strut, which engages the shaft; whereby the guide elements, having the cooperating guide surface (s), are mounted or attached in or on the shaft rod by means of rivets, for example. The guide surfaces of the elements on the shaft rod are designed in the shape of ridges, whereas the ones on the counter-support are designed as grooves, for example. An exactly converse configuration is possible, of course, and it would not change the inventive effect. This effect is achieved in that the guide surfaces interlock with positive fit.

The projection of the side strut is inserted into the shaft rod to couple the shaft rod to the side strut. The guide surfaces of all components come thereby into contact with one another. The guide elements attached to the shaft rod may be drawn together by means of a tensioning bolt to secure the coupling whereby the side struts are held by clamping of their projections. A slot may be placed parallel to the longitudinal axis of the shaft rod and between the two guide elements to achieve the necessary flexibility on the shaft rod. In addition, one of the guide elements may be provided with threads for a tensioning bolt. The projection of the side strut may be provided with a cavity on the inside, extending parallel to the plane of the assembled shaft whereby the space of the cavity extending cross-wise to the plane is slightly larger than the diameter of the bolt. The depth of the cavity is sized in such a manner that the tensioning bolt may be rotated freely in the assembled condition of the side strut and shaft rod. This cavity, which is open toward the shaft rod, makes it possible to separate the side strut from the shaft rod while the tensioning bolt is slightly loosened so that the tensioning bolt does not have to be completely unscrewed from the threads and removed from the shaft rod. Loosening of the tensioning bolt is thereby prevented. Assembly of the side strut and shaft rod is possible in the same fashion. The bolt has to be rotated only slightly thereby.

Additional preferred embodiments of the corner connection defined in the invention are characterized in the dependent claims.

The invention is now explained in more detail by examples in reference to accompanying drawings.

DETAILED DESCRIPTION OF THE INVENTION

Figure 1:
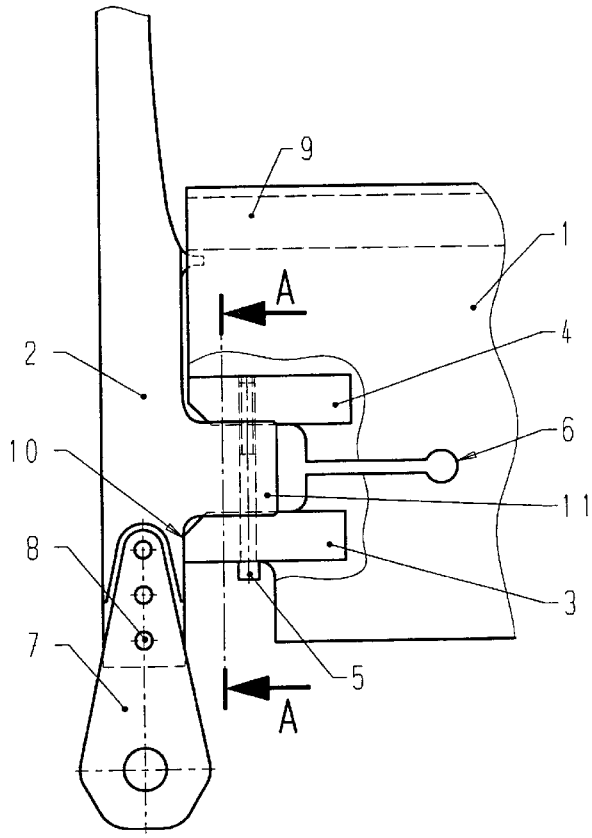
FIG. 1 is a front elevational view an embodiment of the corner connection according to the invention.

Shown in FIG. 1 is a hollow heddle shaft 1, partly broken away, onto which the heddle shaft support bar 9 is attached. A side strut 2, partly broken away, has a projection 11 extending into an end of hollow shaft 1 for engagement between two guide elements, which are firmly arranged in or on the shaft 1, having a stop element 3 and a threaded plate 4. The projection 11 of the side strut is arrested between stop element 3 and threaded plate 4, which are attached in or on the shaft rod 1, whereby the stop element 3 is urged toward the threaded plate 4. This is made possible because the shaft rod has a specific flexibility by the provision of a slot 6 at the end section of the shaft rod. The stop element 3 is provided additionally with a machined surface 10 (see also FIG. 3), which serves to position the side strut 2 in longitudinal direction of the profile of shaft 1. According to the embodiment in FIG. 1, there is also a drive element 7 attached to the side strut 2 by means of riveting 8.

Figure 2:
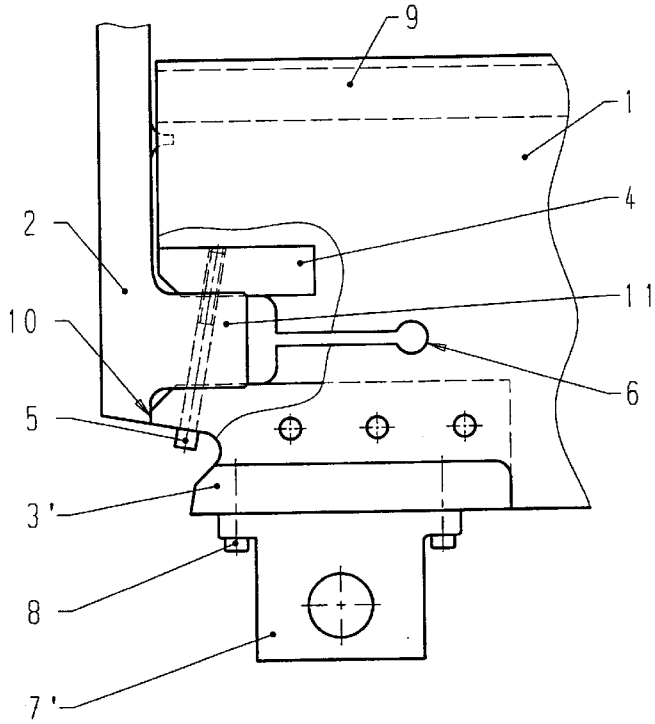
FIG. 2 is a view similar to FIG. 1 of another embodiment of the corner connection of the invention.

FIG. 2 shows a corner connection configured essentially the same as in FIG. 1, whereby the stop element 3' is designed considerably larger so that a drive element 7' for the heddle shaft may be fastened directly to stop element 3' instead of being fastened to side strut 2 as in FIG. 1, for example. Also, the tensioning bolt 5 may be arranged at an angle to the longitudinal axis of the shaft profile 1 instead of vertically as shown in FIG. 1.

Figure 3:
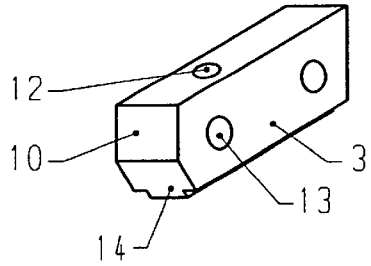
FIG. 3 and FIG. 4 are perspective views of the so-called stop element of FIG. 1 and FIG. 2, respectively.

FIG. 3 is a perspective view of a typical embodiment of a guide element or stop element 3 according to FIG. 1 shown rotated 180°. The positioning elements or surfaces 10 and 14 are clearly visible. The surface 10 is essentially a stop surface for the side strut. The function of guide element 14 is explained in more detail in FIG. 5, stop element 3 being identified therein by reference numeral 20 for clarification.

Holes 13 may extend through stop element 3 for use as rivet holes for attachment of stop element 3 in the cavity of shaft rod 1. Other fastening means such as welding or gluing may be used, depending on the type of material used. Hole 12 serves as a passage for a tensioning bolt 5 according to FIG. 1.

Figure 4:
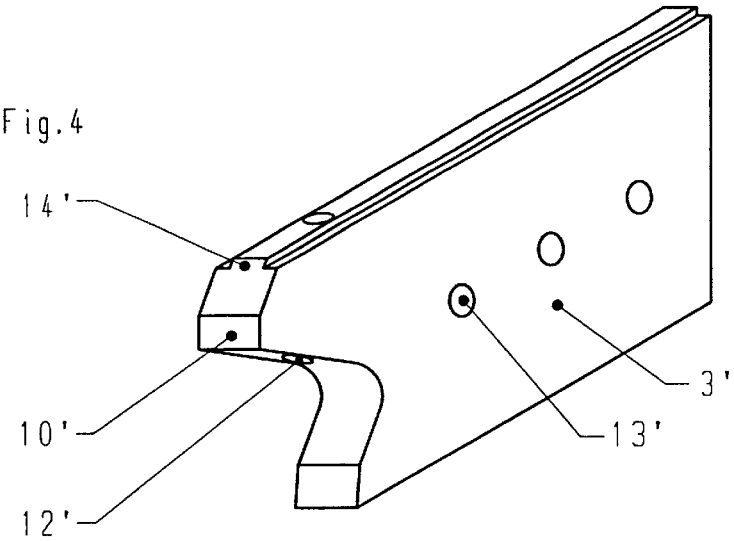

FIG. 4 is a perspective view of a typical embodiment of a guide element or stop element 3' shown in FIG. 2. The positioning elements 10' and 14' are better visible therein. The surface 10' is essentially a stop surface for the side strut. The function of element 14' is explained in more detail in FIG. 5 and it is identified therein by reference numeral 22 for clarification.

Holes 13' may extend through element 3' for use as rivet holes for attachment of stop element 3' in the cavity of the shaft rod 1. Other fastening means such as welding or gluing may be used, depending on the type of material used. The through hole 12' serves as a passage for tensioning bolt 5 according to FIG. 2.

Figure 5:
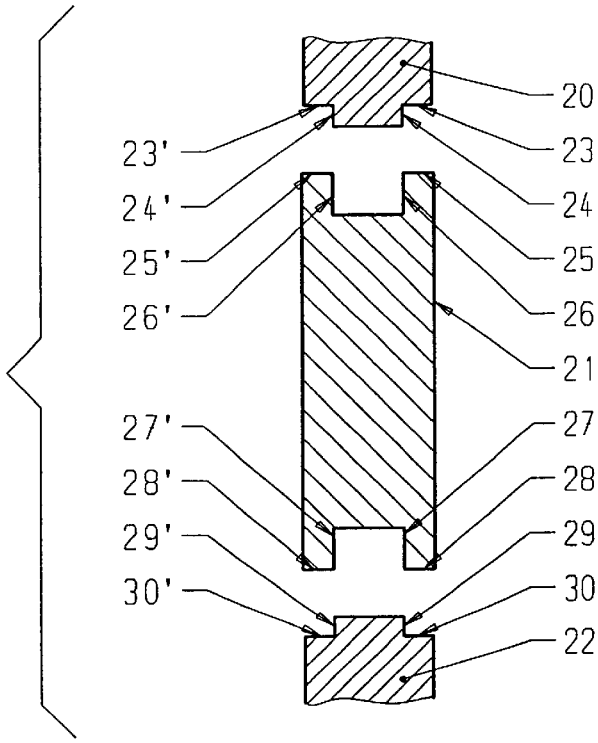
FIG. 5 is a sectional view taken substantially along the line A—A of FIG. 1, rotated 180°, showing the guide surfaces provided for interlocking with positive fit.

FIG. 5 shows a schematic cross-sectional view taken through the positioning element of the corner connection of the invention along the line A—A in FIG. 1. The sectioned stop 14 of the stop element 3 from FIG. 3 is identified by reference numeral 20 for clarification. It is provided with the surfaces 23 and 23' for positioning in a Y-direction and with the surfaces 24 and 24' for positioning in an X-direction of the guide or stop element 3 of FIG. 3.

The surfaces 25 and 25' of section 21 serve as counterparts that respectively come into contact with the surfaces 23 and 23', and surfaces 26 and 26' of section 21 respectively come into contact with surfaces 24 and 24'. The surfaces 28 and 28' as well as 27 and 27' are also located on section number 21, which is a section through the projection 11 of the side strut 2 according to FIG. 1. And, surfaces 28 and 28' as well as 27 and 27' make contact with the cooperating surfaces 30 and 30' or 29 and 29', respectively, which extend in a longitudinal direction on threaded plate 4 according to FIG. 1, which is identified here in the section by reference numeral 22.

The surfaces 30 and 30' on the sectioned threaded plate serve for positioning in a Y-direction the projection 11 of the side strut 2 according to FIG. 1 and the surfaces 29 and 29' for positioning in an X-direction, the projection being identified by reference numeral 21 in the cross-section.

The aforedescribed positioning surfaces acting between projection 11 and threaded plate 4 and stop element 3 of FIG. 1 are the same in shape and function as the positioning surfaces acting between projection 11 and threaded plate 4 and stop element 3' of FIG. 2.

With sufficiently large contact areas of the surfaces 23, 23'; 24, 24', 25, 25' and 26, 26', the symmetrically arranged surfaces 27, 27'; 28, 28'; 29, 29' and 30, 30' may be eliminated. Since precise machining of the surfaces becomes, nevertheless, more difficult and costly with its increasing size, the configuration shown in cross-sectional view in FIG. 5 is preferred.

The cooperating surfaces 23, 23' or 30, 30' as well as 24, 24' or 29, 29' reliably prevent twisting of the side strut relative to the shaft rod—even when these surfaces are small in size. This is an important function since an even surface of the entire shaft layout can be assured only through this function. All embodiments known from prior art, having projections on the side strut engaging the cavity of the shaft rod, do not fulfill this requirement since sufficiently precise machining inside the cavity of the shaft rod would have been very difficult and very costly. The guide elements may, according to the invention, be manufactured in a precise manner with simple means and may, above all, be reproduced in large numbers at low manufacturing cost.

An additional un-illustrated embodiment of the surfaces 24, 24'; 26, 26'; 29, 29'and 27, 27' is possible whereby these surfaces are angled to facilitate dovetail engagement between sections 21, 20 and 21, 22.

The embodiment shown in FIG. 2 is preferably used when drive elements 7' are to be fastened to the outer end of the shaft rod 1. In that case, the shape of the stop element 3' assures that the drive forces, which act upon element 7', are directly transferred to the side strut 2 or its projection 11 so that the shaft profile 1 does not have to transfer such force and be additionally stressed thereby. The same application can also be used with a bolt 5, which is arranged perpendicular to the longitudinal axis of the shaft rod 1 as shown in FIG. 1, as long as this is allowed by the position of the drive element. This will always be the case whenever the distance to the side strut 2 is sufficiently large.

Figure 6:
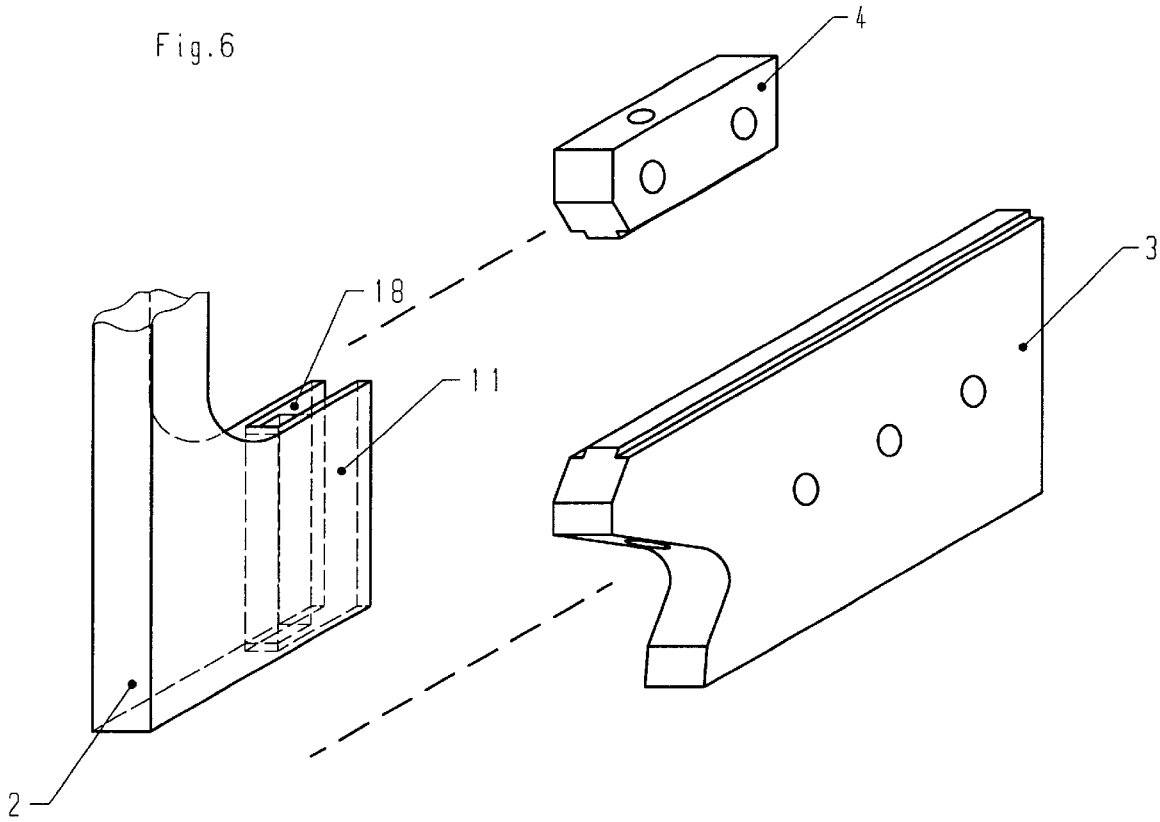
FIG. 6 is an expanded view, in perspective, of the elements of FIG. 3 and FIG. 4 together with a side strut.

FIG. 6 is a perspective illustration of the elements 3 and 4 from FIG. 2—together with a perspective and somewhat simplified illustration of the side strut 2 with a projection 11 thereof to clarify interlocking of the three elements. The cavity 18 for the bolt 5 is also visible therein. The depth of the cavity is at the most about three-fourths the length of projection 11.

Figure 7:
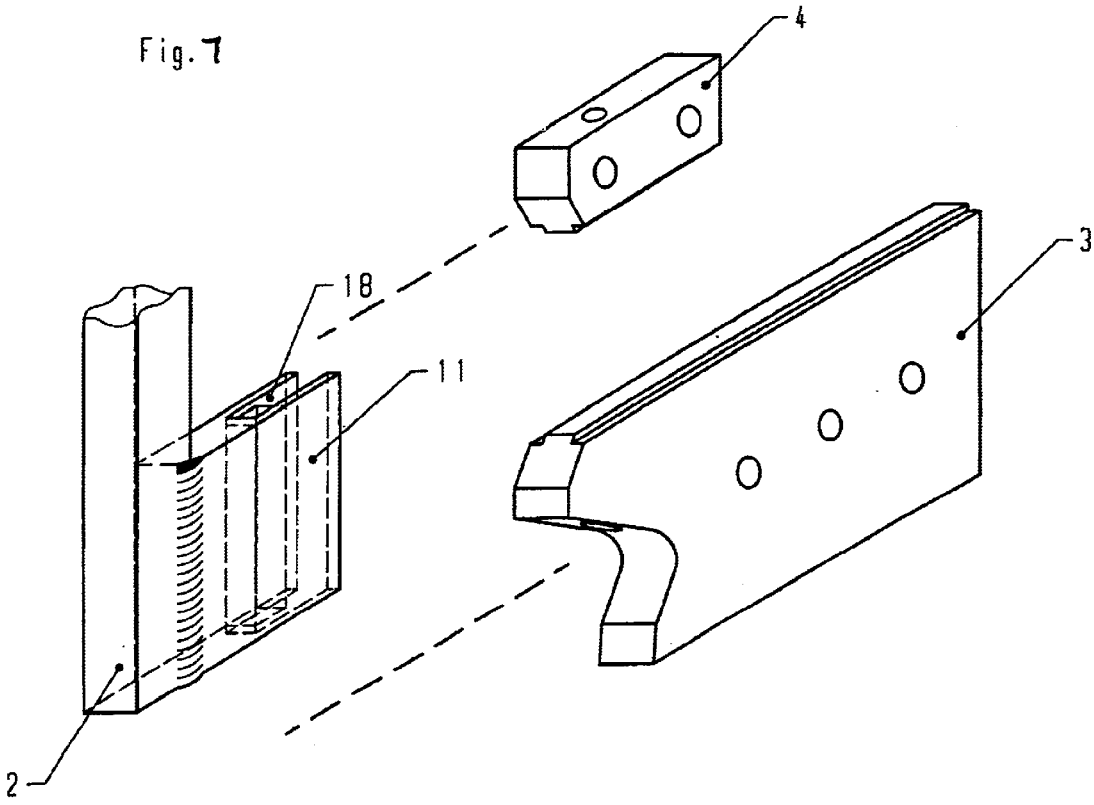
FIG. 7 is a view similar to FIG. 6 of an alternatively structured side strut.

Shaft rod 1 may be of shaped aluminum or steel. And, side strut 2 may be of shaped aluminum or steel pipe. Further, the side strut may be of unitary construction as shown in FIGS. 1 and 2, or may be constructed of parts welded together as at 31 shown in FIG. 7. Otherwise, the shaft rod and/or the side strut may be of a fiber-reinforced synthetic material or a combination of various metals and fiber-reinforced synthetic material, without departing from the invention.

What is claimed is:

1. A connection of an elongated shaft rod of a heddle shaft to a side strut of the heddle shaft, comprising the shaft rod having a hollow end containing at least one guide surface extending substantially parallel to the longitudinal axis of the shaft rod, said guide surface engaging with a positive fit a second guide surface extending along a projection of said side strut substantially parallel to said shaft rod and substantially perpendicular to said side strut.

2. The connection according to claim 1, wherein at least one guide element is mounted to said shaft rod and has said first guide surface which receives with a positive fit the second guide surface on the projection.

3. The connection according to claim 2, wherein a pair of such guide elements are provided, one of said elements having a through hole for a bolt, and the other of said elements provided with a threaded hole for the reception of the bolt such that the guide elements can be pulled together by the bolt, the projection being disposed between the guide elements and being thereby held by clamping to effect a firm connection of the shaft rod to the side strut.

4. The connection according to claim 1, wherein the projection has a cavity in the form of a slot open toward the shaft rod, the depth of the cavity being at the most about three-fourths the length of the projection.

5. The connection according to claim 1, wherein the guide surfaces are provided with means for interlocking the shaft rod and the projection together.

6. The connection according to claim 1, wherein the one guide surface is shaped as a ridge, and the second guide surface is shaped as a groove.

7. The connection according to claim 1, wherein the one guide surface is shaped as a groove, and the second guide surface is shaped as a ridge.

8. The connection according to claim 3, wherein at least one of the guide elements which is attached to the shaft rod is provided with a stop surface for the side strut.

9. The connection according to claim 3, wherein the shaft rod has a slot extending into an end of the shaft rod and located between the two guide elements.

10. The connection according to claim 1, wherein the shaft rod comprises one of shaped aluminum and steel.

11. The connection according to claim 1, wherein the side strut comprises one of shaped aluminum and steel pipe of unitary construction.

12. The connection according to claim 1, wherein the side strut comprises one of shaped aluminum and steel pipe of parts welded together.

13. The connection according to claim 1, wherein the shaft rod comprises one of a fiber-reinforced synthetic material and a combination of metal and fiber-reinforced synthetic material.

14. The connection according to claim 1, wherein the side strut comprises one of a fiber-reinforced synthetic material and a combination of metal and fiber-reinforced synthetic material.

15. The connection according to claim 1, wherein a drive element for the heddle shaft is mounted to the side strut.

16. The connection according to claim 2, wherein a drive element for the heddle shaft engages the guide element in the shaft rod, the drive element being connected to the shaft rod.

* * * * *